US009637943B2

(12) United States Patent
Fiwek et al.

(10) Patent No.: US 9,637,943 B2
(45) Date of Patent: May 2, 2017

(54) COMPRESSIBLE STAND FOR AWNING WITH DETACHABLE SUPPORT LEG

(71) Applicant: LIPPERT COMPONENTS, INC., Elkhart, IN (US)

(72) Inventors: Michael J. Fiwek, Nappanee, IN (US); Jeffrey K. Albrecht, Goshen, IN (US)

(73) Assignee: Lippert Components, Inc., Elkhart, IN (US)

( * ) Notice: Subject to any disclaimer, the term of this patent is extended or adjusted under 35 U.S.C. 154(b) by 0 days.

(21) Appl. No.: 14/937,015

(22) Filed: Nov. 10, 2015

(65) Prior Publication Data

US 2016/0138291 A1 May 19, 2016

Related U.S. Application Data

(60) Provisional application No. 62/079,689, filed on Nov. 14, 2014.

(51) Int. Cl.
*E04H 12/22* (2006.01)
*E04H 15/62* (2006.01)
*E04H 15/08* (2006.01)

(52) U.S. Cl.
CPC ..... *E04H 12/2238* (2013.01); *E04H 12/2261* (2013.01); *E04H 15/08* (2013.01); *E04H 15/62* (2013.01)

(58) Field of Classification Search
CPC ..... E04H 15/60; E04H 15/62; E04H 12/2238; E04H 12/2269; E04H 12/2292; E04H 12/22
USPC ..... 135/116, 114, 88.1, 88.11, 88.12; 248/157, 575, 580, 581, 550, 125.1, 248/125.8, 161, 406.2, 346.06, 599, 600, 248/602
See application file for complete search history.

(56) References Cited

U.S. PATENT DOCUMENTS 1,629,939 A * 5/1927 Turner ..... B60N 2/502 248/418
1,880,181 A * 9/1932 Turner ..... B60N 2/502 248/599
3,521,341 A * 7/1970 Hornlein ..... A47B 9/20 248/161
3,612,145 A * 10/1971 Darula ..... B60P 3/343 135/88.12
4,496,130 A * 1/1985 Toyama ..... B60G 99/002 188/380
4,640,332 A * 2/1987 Turner ..... B60P 3/343 160/46

(Continued)

*Primary Examiner* — Noah Chandler Hawk
(74) *Attorney, Agent, or Firm* — Mark P. Vrla; Barnes & Thornburg LLP

(57) ABSTRACT

A compressible stand for an awning support includes a base plate, a cover, guide posts extending upwardly from the base plate and downwardly from the cover, and a support plate configured with apertures receiving the guide posts in sliding engagement. The support plate supports a leg of the awning support. A biasing member tends to maintain the support plate and leg in a predetermined relationship with respect to the base plate under a normal load. When an additional load is placed on the support plate, the biasing member is compressed, and the support plate and leg are lowered. When the additional load is removed, the biasing member is decompressed, and the support plate and leg may return to their original positions.

18 Claims, 5 Drawing Sheets

(56) References Cited

U.S. PATENT DOCUMENTS

| | | | | | |
|---|---|---|---|---|---|
| 4,831,681 | A * | 5/1989 | Puder | A47K 5/04 | 108/136 |
| 4,948,078 | A * | 8/1990 | Dumenigo | A47K 5/1201 | 15/257.05 |
| 5,094,285 | A * | 3/1992 | Murray | B60P 3/343 | 160/46 |
| 7,213,869 | B1 * | 5/2007 | McClellan | E04H 12/2238 | 248/346.01 |
| 7,850,131 | B2 * | 12/2010 | Battistella | A61G 13/02 | 248/161 |
| 8,316,910 | B2 * | 11/2012 | Popa | E04F 10/0618 | 160/46 |

* cited by examiner

COMPRESSIBLE STAND FOR AWNING WITH DETACHABLE SUPPORT LEG

CROSS-REFERENCE TO RELATED APPLICATIONS

This application claims benefit of U.S. Provisional Patent Application No. 62/079,689, filed on Nov. 14, 2014, and incorporates by reference the disclosure thereof in its entirety.

BACKGROUND OF THE INVENTION

A manually deployable awning system for a vehicle, for example, a recreational vehicle, may include an awning roller attached to the vehicle (or to a support system attached to the vehicle), an awning fabric having a first end attached to the awning roller and a second end connected to a header or stiffener, and a pair of support legs, each support leg having a first end connected to the stiffener and a second end. The second end of the support leg is supported by the ground when the awning is deployed and may be supported by a bracket attached to the vehicle when the awning is stowed.

DETAILED DESCRIPTION OF THE DRAWINGS

Figure 1:
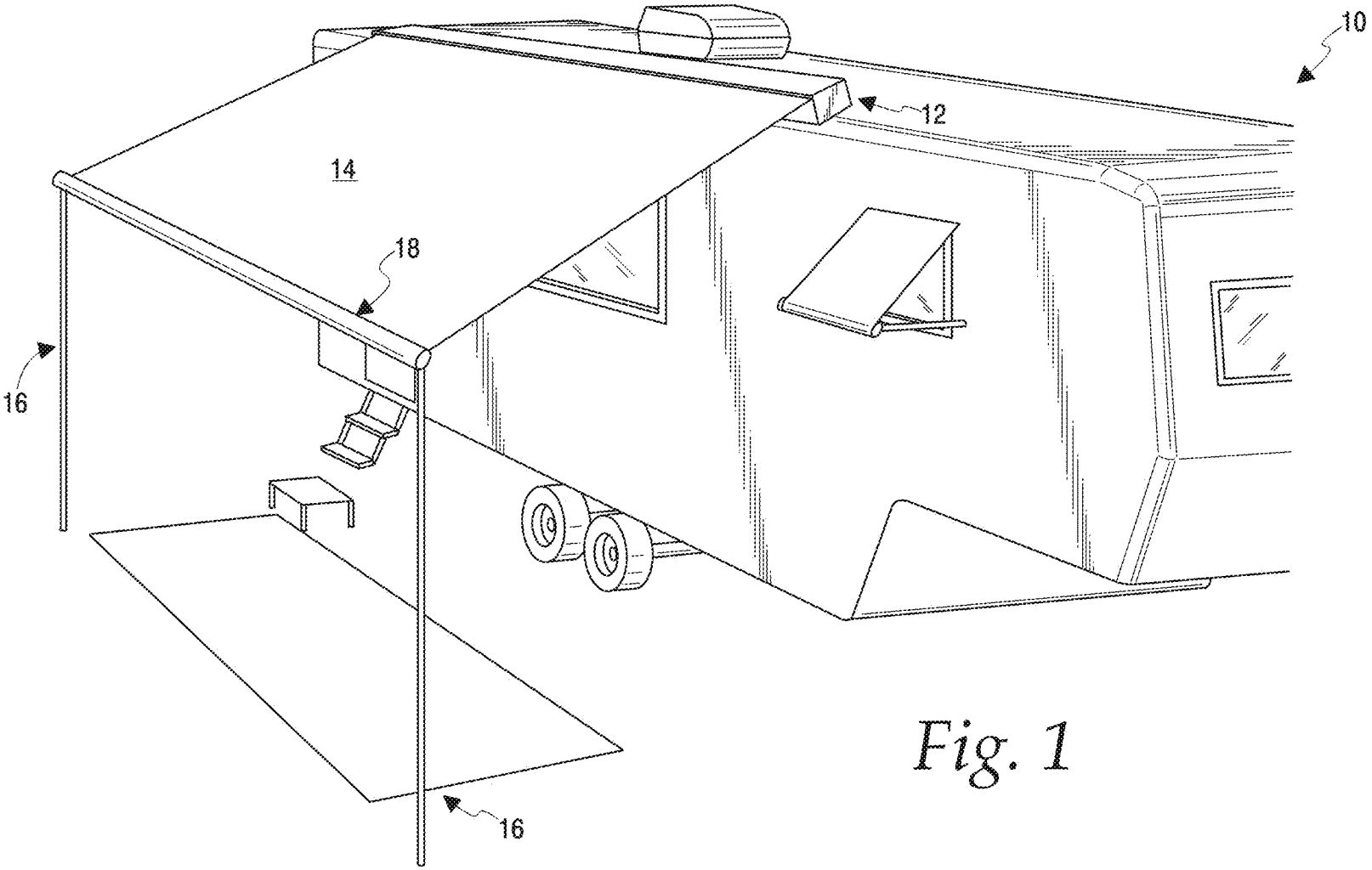
FIG. 1 is a perspective view of a manually-operated awning attached to a vehicle, with the awning in a deployed position and support legs supported by the ground underneath the awning.

FIG. 1 shows a travel trailer 10 (a form of recreational vehicle) having an illustrative manually-operated awning system attached thereto and deployed therefrom. The awning system includes a roller mechanism 12 attached to the trailer 10, a canopy or awning fabric 14 unrolled from the roller mechanism, a header 18, and a pair of support legs 16 supported by the ground under the awning and, in turn, supporting the header.

Figure 2:
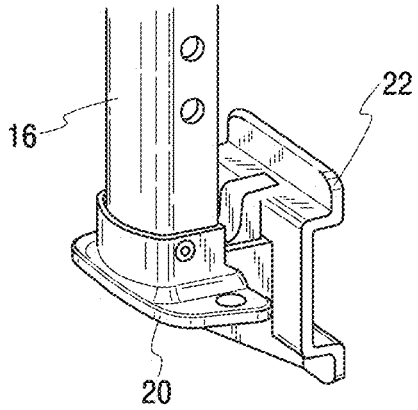
FIG. 2 is a perspective view of an awning support leg and foot in a stowed position in a bracket connectable to a wall of the vehicle.

FIG. 2 shows one of the support legs 16 and a foot 20 attached thereto in a stowed position wherein the leg 16 and 20 are supported by a bracket 22 that is mountable to a wall of the trailer.

Figure 3:
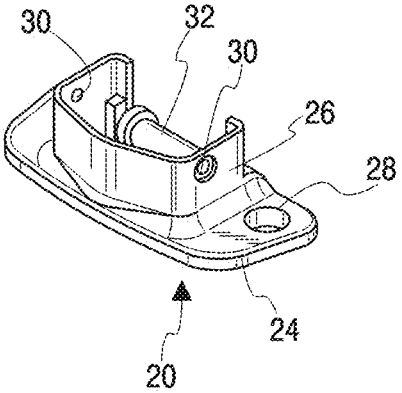
FIG. 3 is a perspective view of the foot of FIG. 2.
Figure 4:
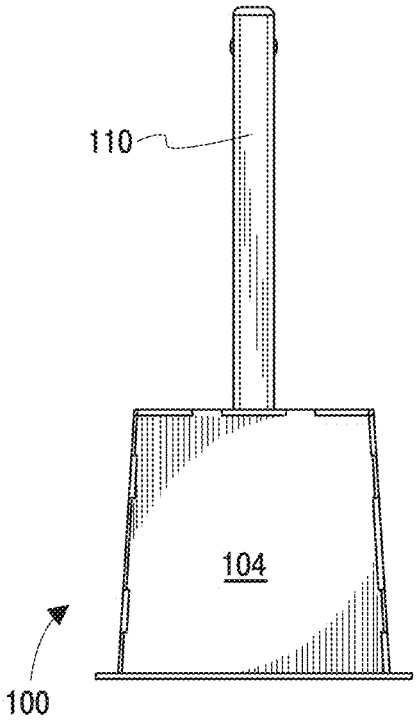
FIG. 4 is a front elevation view of an illustrative compressible stand for an awning support leg in an extended state.
Figure 5:
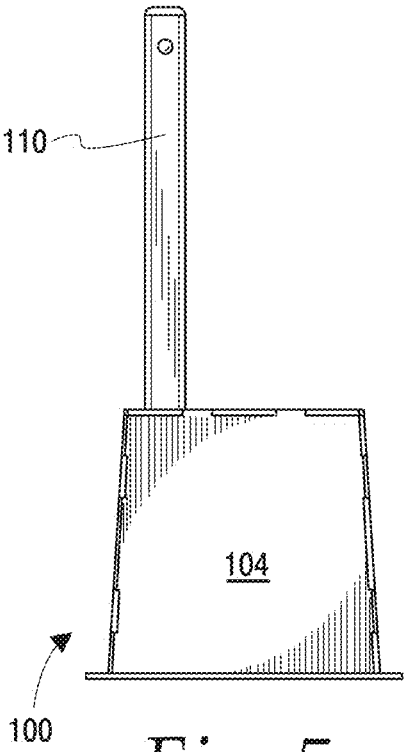
FIG. 5 is a side elevation view of an illustrative compressible stand for an awning support leg in an extended state.
Figure 6:
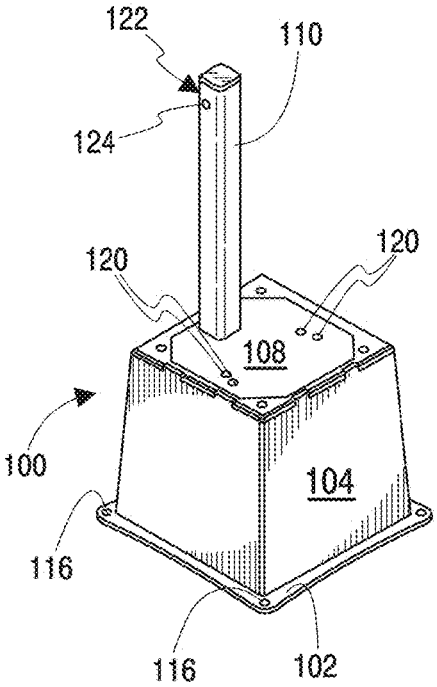
FIG. 6 is a perspective view of an illustrative compressible stand for an awning support leg in an extended state.
Figure 7:
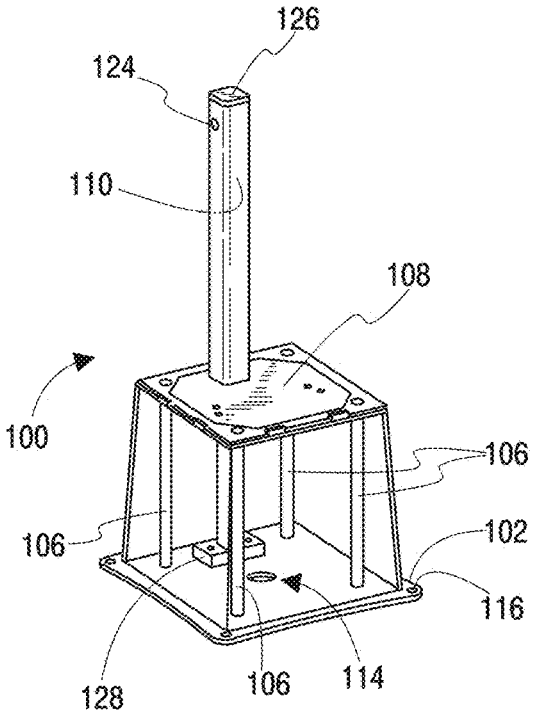
FIG. 7 is a partial cut-away perspective view of an illustrative compressible stand for an awning support leg in an extended state.
Figure 8:
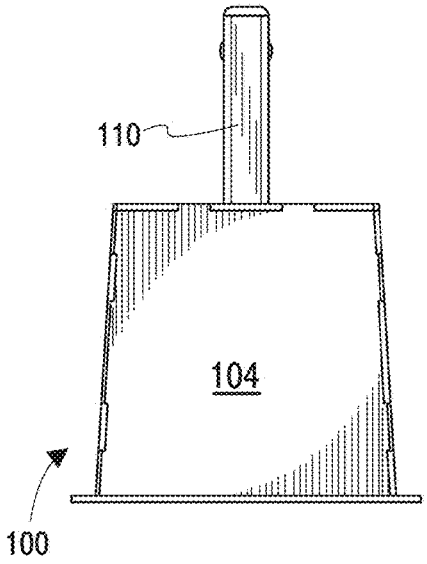
FIG. 8 is a front elevation view of an illustrative compressible stand for an awning support leg in a compressed state.
Figure 9:
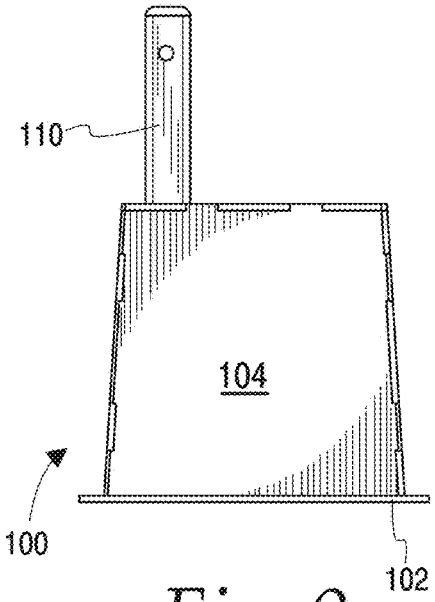
FIG. 9 is a side elevation view of an illustrative compressible stand for an awning support leg in a compressed state.
Figure 10:
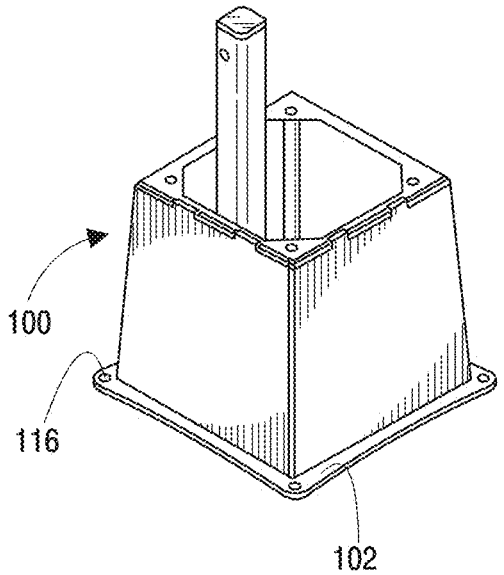
FIG. 10 is a perspective view of an illustrative compressible stand for an awning support leg in a compressed state.
Figure 11:
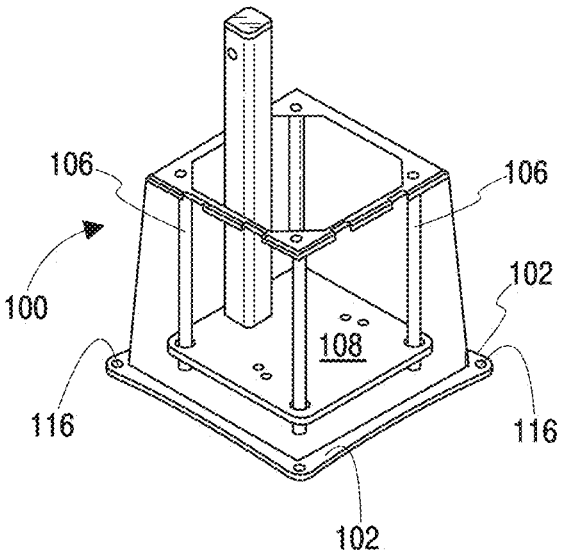
FIG. 11 is a partial cut-away perspective view of an illustrative compressible stand for an awning support leg in a compressed state.
Figure 12:
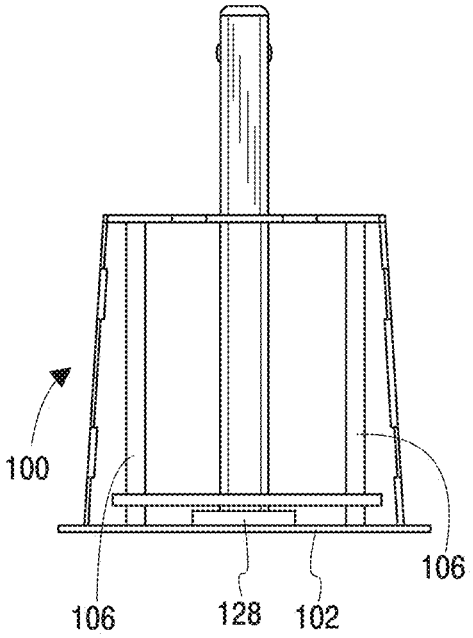
FIG. 12 is a partial cut-away front elevation view of an illustrative compressible stand for an awning support leg in a compressed state.
Figure 13:
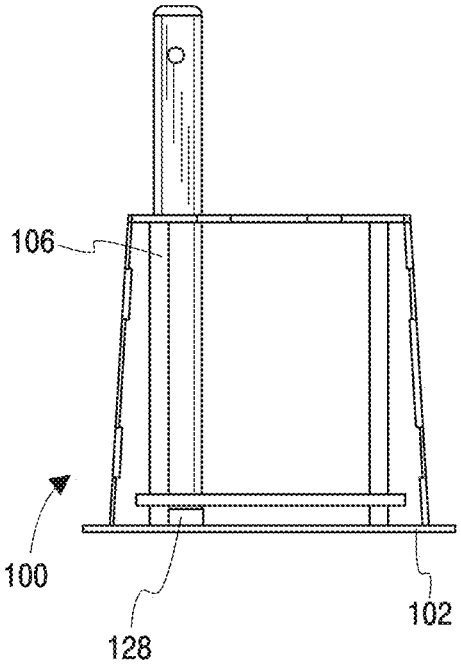
FIG. 13 is a partial cut-away side elevation view of an illustrative compressible stand for an awning support leg in a compressed state.

FIG. 3 shows the foot 20 in greater detail. The foot 20 includes a base 24 defining apertures 28. The apertures 28 are configured to receive stakes or fasteners (not shown) that might be used to secure the foot 20 the ground or to a compressible stand, as will be discussed further below. The foot 20 also includes a channel 26 extending perpendicularly from the base 24. The channel 26 is configured to receive an end of the leg 16 therein. The channel 26 may define apertures 30 configured to receive fasteners (not shown) for securing the foot 20 to the leg 16. The foot 20 further includes a trunnion 32 configured to cooperated with complementary structure of the bracket 22 to secure the foot to the bracket when the awning is stowed.

FIGS. 4-15 show an illustrative compressible stand 100. The stand 100 includes a base plate 102, a cover 104, four guide posts 106 connected to the base plate and the cover, a support plate 108 configured for translation with respect to the base plate and restrained by the guide posts, a hollow tower 110 connected to the support plate, and a biasing member 112 connected between the tower 110 and the base plate 102.

The base plate 102 is shown as a square plate having an aperture 114 proximate its center. The aperture 114 may provide a drain path for water that may accumulate within the stand 100. Apertures 116 may be provided at the periphery of the base plate, for example, proximate the corners thereof. The apertures 116 may be configured to receive stakes (not shown) therethrough for insertion into the ground beneath the stand 100 to secure the stand thereto.

The guide posts 106 may be generally cylindrical, or they may have other suitable cross-sections. The guide posts 106 may be connected to the base plate 102 and the cover 104 by any suitable means. For example, the guide posts 106 could be welded or bonded to the base plate 102, staked thereto, secured thereto using mechanical fasteners (not shown), or attached thereto by any other suitable means or combination of means. The guide posts 106 may be parallel to each other and perpendicular to the base plate 102. The guide posts 106 may be made of a low-friction material or have a low friction surface or surface coating.

The support plate 108 is shown as a square plate having four apertures 118, each configured to receive a corresponding one of the guide posts 106. The support plate 108 may further include apertures 120 for receiving fasteners securing the foot 20 of the support leg 16 thereto.

The tower 110 is connected to and extends upwardly from the support plate 108. The tower 110 may include one or more pin-receiving apertures 122 proximate an end thereof, configured to receive a pin 124 connecting the biasing member 112 to the tower 110, as will be discussed further below. An end cap 126 may be provide to cover a free end of the tower 110

A support block 128 may be connected to a first or interior surface of the base plate 102, for example, proximate a side edge of the base plate and between adjacent corners thereof. A first end of the biasing member 112 may be connected to the support block 128. Alternatively, the support block 128 could be omitted and the first end of the biasing member 112 could be connected directly to the base plate 102, or the biasing member 112 could be connected to the base plate 102 through another intervening member.

As discussed above, a first end of the biasing member 112 is connected to the base plate 102, directly or through the support block 128 or another intervening member. As also discussed above, a second end of the biasing member is connected to the tower 110. As such, at least a portion of the biasing member 112 is disposed within the tower 110.

The biasing member 112 may be a telescopic actuator, for example, a gas strut. Alternatively, the biasing member may be any suitable form of biasing member, for example, a coil spring a resiliently compressible elastomeric member, etc. The biasing member 112 may have attachment eyes or other attachment means at one or both ends to facilitate connection to the base plate 102 or the support block 128 and to the tower 110.

Figure 14:
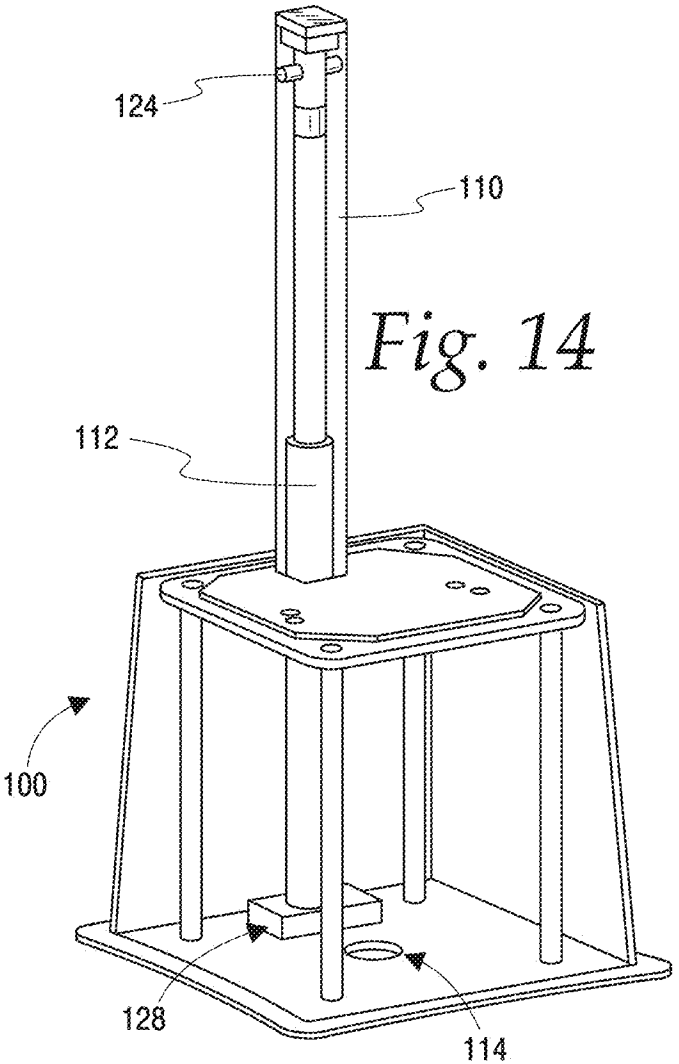
FIG. 14 is a partial cut-away perspective view of an illustrative compressible stand for an awning support leg in an extended state.
Figure 15:
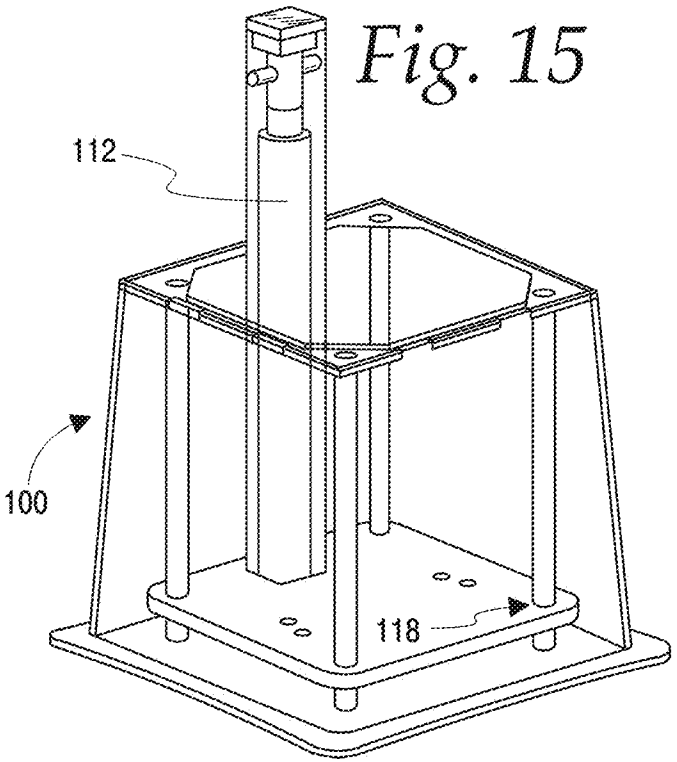
FIG. 15 is a partial cut-away perspective view of an illustrative compressible stand for an awning support leg in a compressed state.

The cover 104 may be attached to the base plate 102, for example, by welding or using fasteners. The cover 104 is shown as a five-sided structure having an open bottom to allow the cover to be placed over the base plate 102 and guide posts 106 and support plate 108 without interfering with the motion of the support plate relative to the base plate and guide posts. The cover has four side walls, each corresponding to a side of the base plate. Opposing side walls of the cover 104 may be parallel to each other, or configured so that the top of the cover is dimensionally smaller than the bottom of the cover. That is, the side walls of the cover 104 may taper outwardly from the top thereof to the bottom thereof. The top of the cover 104 is mostly open, but has sufficient peripheral edge structure to capture the support plate 108 within the cover 104 and prevent it from exiting the cover during normal operation. The top of the cover 104 also has sufficient peripheral edge structure to provide a surface to which the upper ends of the guide posts 106 may be attached. These features are best shown in FIGS. 14 and 15.

In use, the stand 100 may be staked to the ground using one or more stakes (not shown) engaged through one or more corresponding apertures 116 in the base plate. The foot 20 of the awning system may be placed upon the support plate 106 or attached thereto using fasteners engaged through the apertures 28 in the foot 20 and the apertures 120 in the support plate 106.

The biasing member 112 may be configured to overcome the dead weight of the attached foot 20, leg 16, header 18, and canopy 14 so as to support the header 18 at or about at a predetermined position. In this condition, the support plate 106 may be topped out against the underside of the cover 104. Alternatively, the support plate could be positioned between the base plate 102 and the underside of the cover 104. In the event an additional weight is placed upon the canopy 14, for example, the weight of rainwater that may have collected upon the canopy, the additional weight is transferred through the header 18, the leg 16, and the foot 20 to the support plate 104. The support plate 104 transfers the additional weight to the tower 110 and the biasing member 112. The additional weight at least partially overcomes the biasing force of the biasing member 112, thereby compressing the biasing member 112 and correspondingly lowering the support plate 106, the foot 20, the leg 16, and the header 18.

If only one leg 16 of the awning system is supported by a compressible stand 100 and the other leg is rigidly supported by the ground or otherwise, the end of the header 18 supported by the one leg may be lowered when the compressible stand 100 is compressed as described above, but the end of the header supported by the other leg will not be. As such, the header 18 (and the portion of the canopy 14 connected thereto) will become skewed. Once the header 18 has become sufficiently skewed, the collected rainwater will flow off of the canopy 14 to one side. If both legs 16 of the awning system are supported by a compressible stand 100, the header 18 may become skewed, thereby allowing the collected rainwater to flow off as described above. Alternatively, both ends of the header 18 may be lowered substantially equally. When the header 18 has become sufficiently lowered, the collected rainwater may flow off the end of the canopy 14 adjacent the header. In any event, with the weight of the rainwater removed, the biasing member 112 and tower 110 may return to or toward their original positions.

In an embodiment, a compressible stand 110 is used in connection with only one of the legs 16. In another embodiment, a compressible stand 110 is used in connection with both of the legs 16.

The drawings and descriptions of this disclosure are illustrative and may be modified with limiting the scope of the appended claims.

The invention claimed is:

1. A compressible support stand comprising:

a base plate having a surface:

a plurality of guide posts extending from said surface, said guide posts generally perpendicular to said surface and generally parallel to each other;

a cover attached to said base plate, said cover overlying said at least a portion of said surface of said base plate, and said cover at least partially encompassing said plurality of guide posts;

a support plate defining a first plurality of apertures, each one of said first plurality of apertures receiving a corresponding one of said plurality of guide posts in sliding engagement, said support plate captured between said base plate and said cover; and a biasing member configured to bias said support plate away from said base plate, each of said plurality of guide posts having a first end and a second end, said first ends connected to said base plate and said second ends connected to said cover.

2. The compressible support stand of claim 1, said biasing member comprising a spring disposed between said base plate and said support plate.

3. The compressible support stand of claim 1, said biasing member comprising a telescopic actuator.

4. The compressible support stand of claim 3 further comprising a tower attached to said support plate and extending therefrom, said telescopic actuator having a first end disposed within and attached to said tower, and said telescopic actuator having a second end connected to said base plate.

5. The compressible support stand of claim 4, said base plate comprising a support block, said second end of said telescopic actuator attached to said support block.

6. The compressible support stand of claim 1, said cover having a top defining an aperture and a side wall extending downwardly from said top.

7. The compressible support stand of claim 6, each of said plurality of guide posts attached to said cover.

8. The compressible support stand of claim 6, said top configured to capture said support plate between said base plate and said top.

9. The compressible support stand of claim 1, wherein said side wall is generally rectangular.

10. The compressible support stand of claim 1, said base defining a drainage aperture.

11. The compressible support stand of claim 10, said base defining at least one securement aperture.

12. The compressible support stand of claim 1 wherein said biasing member is selected to permit displacement of said support plate toward said base plate when a load applied to said support plate exceeds a predetermined threshold.

13. An awning system comprising:

an awning header having a first end and a second end;

an awning canopy having a first end and a second end, said first end of said awning canopy attached to the awning header, and said second end of said awning canopy configured for attachment to a structure;

a compressible support stand comprising:

a base plate having a surface;

a plurality of guide posts extending from said surface, said guide posts generally perpendicular to said surface and generally parallel to each other;

a cover attached to said base plate, said cover overlying said at least a portion of said surface of said base plate, and said cover at least partially encompassing said plurality of guide posts;

a support plate defining a first plurality of apertures, each one of said first plurality of apertures receiving a corresponding one of said plurality of guide posts in sliding engagement, said support plate captured between said base plate and said cover; and a biasing member configured to bias said support plate away from said base plate;

a first support leg extending between said first end of said awning header and said support plate; and a second support leg extending downwardly from said second end of said awning header;

each of said plurality of guide posts having a first end and a second end, said first ends connected to said base plate and said second ends connected to said cover.

14. The awning system of claim 13, said cover having a top defining an aperture and a side wall extending downwardly from said top.

15. The awning system of claim 14, said first support leg attached to said support plate and at least a portion of said first support leg translatable through said aperture defined by said top.

16. The awning system of claim 15, said support plate further defining at least one second aperture, and said first support leg further comprising a foot, said foot defining at least one aperture, and a fastener disposed through said at least one second aperture of said support plate and said at least one aperture of said foot.

17. The awning system of claim 13 wherein said biasing member is selected to permit displacement of said support plate toward said base plate when a load applied to said first support leg exceeds a predetermined threshold.

18. The awning system of claim 13 further comprising:

a second compressible support stand comprising:

a base plate having a surface;

a plurality of guide posts extending from said surface, said guide posts generally perpendicular to said surface and generally parallel to each other;

a cover attached to said base plate, said cover overlying said at least a portion of said surface of said base plate, and said cover at least partially encompassing said plurality of guide posts;

a support plate defining a first plurality of apertures, each one of said first plurality of apertures receiving a corresponding one of said plurality of guide posts in sliding engagement, said support plate captured between said base plate and said cover; and a biasing member configured to bias said support plate away from said base plate;

said second support leg extending between said second end of said awning header and said support plate of said second compressible support stand.

* * * * *